US011156132B2

(12) United States Patent
Grynberg et al.

(10) Patent No.: US 11,156,132 B2
(45) Date of Patent: Oct. 26, 2021

(54) VALVE ACTUATION SYSTEM FOR AN INTERNAL COMBUSTION ENGINE

(71) Applicant: VOLVO TRUCK CORPORATION, Gothenburg (SE)

(72) Inventors: Philippe Grynberg, Oullins (FR); Romain Riviere, Pollionnay (FR); Damien Didiot, Seremange-Erzange (FR); Arnaud Roque, Marignane (FR); Foudil Abderrahim, Saint-Genis-Laval (FR)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/956,380

(22) PCT Filed: Dec. 21, 2017

(86) PCT No.: PCT/EP2017/084262
§ 371 (c)(1),
(2) Date: Jun. 19, 2020

(87) PCT Pub. No.: WO2019/120556
PCT Pub. Date: Jun. 27, 2019

(65) Prior Publication Data
US 2021/0108542 A1 Apr. 15, 2021

(51) Int. Cl.
*F01L 13/06* (2006.01)
*F01L 1/08* (2006.01)
(Continued)

(52) U.S. Cl.
CPC ..... *F01L 1/08* (2013.01); *F01L 1/053* (2013.01); *F01L 1/18* (2013.01); *F01L 1/181* (2013.01); *F01L 1/26* (2013.01); *F01L 13/06* (2013.01)

(58) Field of Classification Search
CPC ... F01L 1/053; F01L 1/08; F01L 1/181; F01L 1/26; F01L 13/06
(Continued)

(56) References Cited

U.S. PATENT DOCUMENTS 6,253,730 B1 * 7/2001 Gustafson ..... F01L 9/10 123/321
7,712,449 B1 * 5/2010 Schwoerer ..... F01L 13/06 123/321
(Continued)

FOREIGN PATENT DOCUMENTS

WO 2013005070 A1 1/2013

OTHER PUBLICATIONS

International Search Report and Written Opinion dated Jun. 20, 2018 in corresponding International PCT Application No. PCT/EP2017/084262, 9 pages.

*Primary Examiner* — Jorge L Leon, Jr.
(74) *Attorney, Agent, or Firm* — Venable LLP; Jeffri A. Kaminski

(57) ABSTRACT

A valve actuation system for an internal combustion engine The valve actuation system (S) for an internal combustion engine comprises: •a rocker (6) pivotably mounted around a pivot axis (A6), comprising: •a driven end portion (62) for cooperating with a rotating cam including a main bump and at least one smaller auxiliary bump; •an actuating end portion (63) including a piston (8) for opening at least one valve of the engine following the cooperation of the driven end portion (62) with a bump of the cam, the piston (8) being slidably mounted relative to the rocker (6) between a extended position allowing said piston (8) to open said valve when the driven end portion (62) contacts the auxiliary bump, and a retracted position preventing said piston (8) to open said valve when the driven end portion (62) contacts the auxiliary bump; •a fluid circuit for causing the piston (8) to move from its retracted position to its extended position; •a reset circuit comprising a reset valve (99) rotatably
(Continued)

mounted relative to the rocker (6), between an inactive position, and an active position in which the reset valve (99) causes the fluid to be drained out of the fluid circuit to allow the piston (8) to move towards its retracted position; •a lever (7) pivotably mounted around a pivot axis (A6), the lever (7) having a driven end portion (72) adapted to cooperate with a rotating reset cam including a bump, and an actuating end portion (73) for rotating the reset valve (99) from its inactive position towards its active position following the cooperation of the lever driven end portion (72) with the bump of the reset cam; •rotational coupling means (75, 95) between the lever (7) and the reset valve (99), said rotational coupling means having a transmission ratio greater than 1.

11 Claims, 8 Drawing Sheets

(51) Int. Cl.

| | |
|---|---|
| ***F01L 1/053*** | (2006.01) |
| ***F01L 1/18*** | (2006.01) |
| ***F01L 1/26*** | (2006.01) |

(58) Field of Classification Search
USPC ..... 123/90.27, 90.39, 90.4, 90.44
See application file for complete search history.

(56) References Cited

U.S. PATENT DOCUMENTS

| | | | | |
|---|---|---|---|---|
| 2003/0024501 | A1* | 2/2003 | McCarthy | F01L 13/065 123/321 |
| 2008/0223325 | A1* | 9/2008 | Meistrick | F01L 13/065 123/90.46 |
| 2014/0083381 | A1* | 3/2014 | Roberts | F01L 1/08 123/90.15 |
| 2014/0130774 | A1* | 5/2014 | Le Forestier | F02D 9/06 123/321 |
| 2015/0144096 | A1* | 5/2015 | Meneely | F01L 13/06 123/321 |
| 2019/0107011 | A1* | 4/2019 | Contarin | F01L 1/267 |

* cited by examiner

Inlet valve lift
Exhaust lift - Outer lift (valve 5)
Exhaust lift - Inner lift (valve 4)
Exhaust lift - Inner lift (valve 4) without reset valve

VALVE ACTUATION SYSTEM FOR AN INTERNAL COMBUSTION ENGINE

CROSS-REFERENCE TO RELATED APPLICATIONS

This application is a U.S. National Stage application of PCT/EP2017/084262, filed Dec. 21, 2017 and published on Jun. 27, 2019 as WO 2019/120556 A1, all of which is hereby incorporated by reference in its entirety.

TECHNICAL FIELD

The invention relates to a valve actuation system for an internal combustion engine, to an engine arrangement comprising such a valve actuation system, and to a vehicle comprising such a system or arrangement.

The invention can be applied in heavy-duty and medium-duty vehicles, such as trucks, buses and construction equipment.

BACKGROUND

An internal combustion engine conventionally comprises several cylinders, each provided with at least one intake valve and at least one exhaust valve. Such an engine can further be equipped with a valve actuation system, especially for performing an engine brake function. To that end, for each cylinder, the valve actuation system comprises a rocker mounted on a rocker shaft for operating the exhaust valves, a camshaft with a cam for each rocker, said cam cooperating with a cam follower at one end of the rocker. A valve play take-up device, arranged between an opposite end of the rocker and the exhaust valve, comprises a piston able to urge at least one exhaust valve towards its open position. The valve play take-up device is configured for taking-up a play between the piston and the exhaust valve. The piston received in a chamber disposed in said opposite rocker end, and a hydraulic circuit with valve means for supplying or draining a fluid to and from said chamber.

More specifically, the hydraulic circuit comprises a reset valve which, in an active position, causes the fluid to be drained out of the chamber. As a result, the piston slides in the chamber away from the valve, so that the play between the piston and the valve reappears. When the reset valve is activated, the piston is therefore moved in a rest or deactivated position. The deactivation of the piston appears when the engine brake function is used. The deactivation of the piston is instantaneously and occurs during a period of the cam revolution.

The reset valve can be moved from an inactive position to the above described active position by means of a lever. For example, the lever can be mounted around a pivot axis and can be pivoted by a reset cam cooperating with a cam follower at one end of the lever, thereby causing the pivoting of the reset valve.

However, the known arrangements are not fully satisfactory, especially in terms of compactness, sustainability and/or mechanical efficiency.

It therefore appears that, from several standpoints, there is room for improvement in valve actuation systems.

SUMMARY

An object of the invention is to provide a valve actuation system that improves the known systems with respect to at least one of the above mentioned drawbacks.

To that end, according to a first aspect, the invention relates to a valve actuation system for an internal combustion engine, said valve actuation system comprising:

- a rocker pivotably mounted around a pivot axis and having:
  - a driven end portion adapted to cooperate with a rotating cam including a main bump and at least one auxiliary bump having a smaller radial dimension than the main bump;
  - an actuating end portion equipped with at least one piston adapted to open at least one valve of the engine following the cooperation of the driven end portion with a bump of the cam, the piston being slidably mounted relative to the rocker between an extended position allowing said piston to open said valve when the driven end portion contacts the auxiliary bump, and a retracted position preventing said piston to open said valve when the driven end portion contacts the auxiliary bump;
- the rocker comprising:
  - a fluid circuit for providing a fluid in order to cause the piston to move from its retracted position to its extended position;
  - a reset circuit comprising a reset valve rotatably mounted relative to the rocker, between an inactive position, and an active position in which the reset valve causes the fluid to be drained out of the fluid circuit to allow the piston to move towards its retracted position;
- a lever pivotably mounted around a pivot axis, the lever having a driven end portion adapted to cooperate with a rotating reset cam including at least one bump, and an actuating end portion for rotating the reset valve from its inactive position towards its active position following the cooperation of the lever driven end portion with the bump of the reset cam;
- rotational coupling means between the lever and the reset valve, said rotational coupling means having a transmission ratio greater than 1.

The transmission ratio is the ratio between the reset valve angular velocity and the lever angular velocity. By the provision of coupling means having a transmission ratio greater than 1, the invention provides a multiplication effect. In other words, the rotational motion of the lever is transmitted to the reset valve that rotates with an amplified motion.

As a result, to achieve a given rotation of the reset valve, which is necessary to rotate the reset valve from its inactive position to its active position, the invention only requires a limited rotation of the lever, as compared with prior art devices. Consequently, the invention is advantageous in terms of packaging, as it can be implemented in limited spaces.

Moreover, the invention requires a lower moment arm to achieve the necessary range of motion for the reset valve between its inactive position to its active position. As a consequence, inertia and imbalance issues are limited, and a weight gain is obtained for the whole valve actuation system. Ultimately, the components of the valve actuation system are subjected to lesser mechanical forces, which results in a more robust system having a longer service life. This advantage is enhanced by the fact that the main components are rotating parts, and that their cooperation does not combine translations and rotations, as such a movement combination is generally detrimental to robustness.

The invention further makes it possible to improve mechanical efficiency as well as the lever guidance—as the lever is guided around a fixed part.

It has to be noted that the cam and the reset cam are separate parts, even if their rotation movements are identical as they can be fixedly mounted on a same shaft. Besides, the rocker and the lever are also separate parts, which are not secured to one another. The movements of the rocker and lever are different, even if the pivot axes are identical and if the cam and reset cams are fixedly mounted on a same shaft. Moreover, the lever, which can be arranged on the side of the rocker, can be used as a spacer to keep the rocker in position.

In concrete terms, in an embodiment, the extended position of the piston can result in the activation of an engine brake function, whereas in the retracted position of the piston, a gap is provided between the piston and the valve (or an opening member secured to valve), thus preventing the piston to open the valve when the driven end portion of the rocker contacts an auxiliary bump of the cam.

The transmission ratio can range from 2 to 15. A lower ratio would be difficult to implement due to available space limitations (camshaft diameter, radial dimension of the reset cam bump, angle of the reset valve, limited space below the valve actuation system, etc.). A higher ratio would require too precise dimension tolerances, or would lead to adjustment difficulties, or would impair repeatability.

The transmission ratio can preferably range from 3.6 to 9. In an implementation, because of the limited space around the valve actuation system, the lever cannot rotate by more than 15°, which makes the minimum ratio around 3.6. The maximum value of 9 has been calculated taking into account the gear module, as well as the minimum number of teeth pertaining to an example of the rotational coupling means to ensure a satisfactory sustainability and an angle of motion large enough to provide the required movement of the reset valve without requiring too precise tolerances. A ratio around 9 results from a rotation of the lever by about 6°.

For example, the transmission ratio is around 5.5.

In an embodiment, the rocker and the lever are pivotably mounted around one and the same pivot axis. As regards the reset valve, it can be mounted about an axis which is parallel to the pivot axis.

According to an embodiment, the lever comprises a portion having a cylindrical outer surface provided with teeth, and in the reset valve comprises a rod which protrudes outside the rocker towards the lever and which is provided with teeth, the teeth of the lever and the teeth of the reset valve forming at least part of the coupling means.

The lever driven end portion may comprise a leg which protrudes substantially radially away from the pivot axis, said leg having a free end adapted to be in contact with the reset cam.

The valve actuation system may further comprise an activation member which is fixedly mounted on the rocker actuating end portion in operation, said activation member being adapted to cooperate with a valve bridge for simultaneously opening two valves of the engine following the cooperation of the driven end portion with the cam main bump. With such an arrangement, known as single valve brake technology, both valves are opened during the corresponding stroke of the engine by means of the activation member and valve bridge, but only one valve is opened to realize an engine brake function, by means of the sliding piston. This technology allows reducing the forces exerted on the valve actuation system, in order to improve its reliability, and/or allows the exhaust brake valve openings to be performed at moments where the pressure in the cylinder is higher. It has to be noted that, while the activation member cannot move relative to the rocker when the system is in operation, the position of the activation member with respect to the rocker can be preliminary set by an appropriate means, such as an adjusting screw, and can be changed if need be, for example during maintenance.

According to an embodiment, the valve actuation system is an exhaust valve actuation system. For example, the piston allows activating an engine brake function when it is in its extended position.

The invention further relates to an engine arrangement comprising:

- a valve actuation system as previously described;
- a rocker shaft having a pivot axis, the rocker of the valve actuation system, and preferably the lever, being pivotably mounted on said rocker shaft;
- a camshaft on which are secured a reset cam including at least one bump, and a cam including a main bump and at least one auxiliary bump having a smaller radial dimension than the main bump, the rocker and the lever being adapted for cooperating with the cam and the reset cam, respectively;
- two valves, the piston which is slidably mounted relative to the rocker being adapted to open at least one of said valves.

The pivot axis may be parallel to the camshaft axis.

In a so-called single valve brake technology, the engine arrangement may further comprise a valve bridge moveable by the activation member for simultaneously opening the two valves, wherein the valve bridge comprises a hole through which is slidably engaged an opening member secured to the valve, and operable by the piston, so that the piston is able to open only one valve.

The invention also relates to a vehicle which comprises a valve actuation system as previously described or an engine arrangement as previously described.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
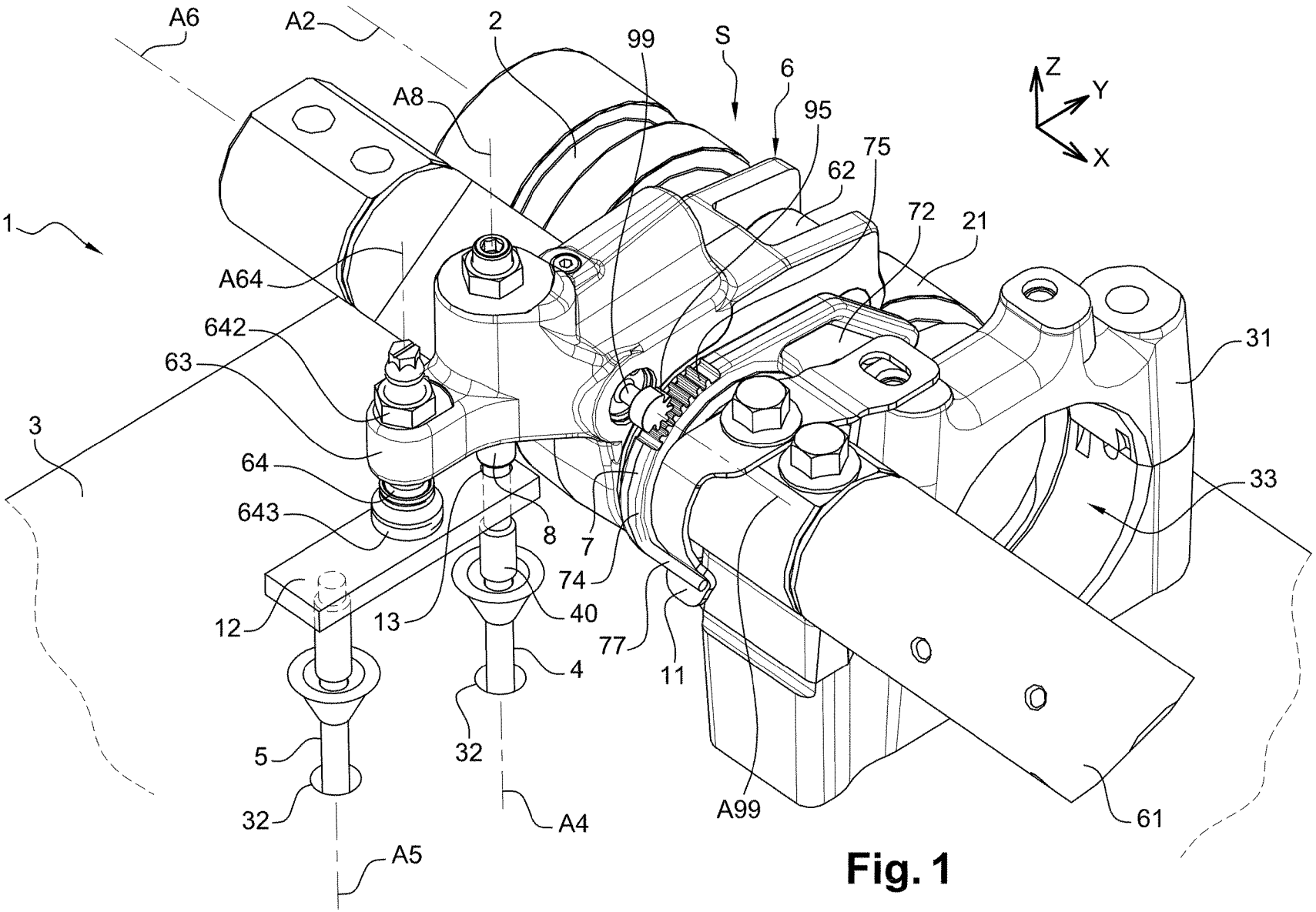
FIG. 1 is a partial perspective view of an engine arrangement comprising a valve actuation system according to an embodiment of the invention.
Figure 2:
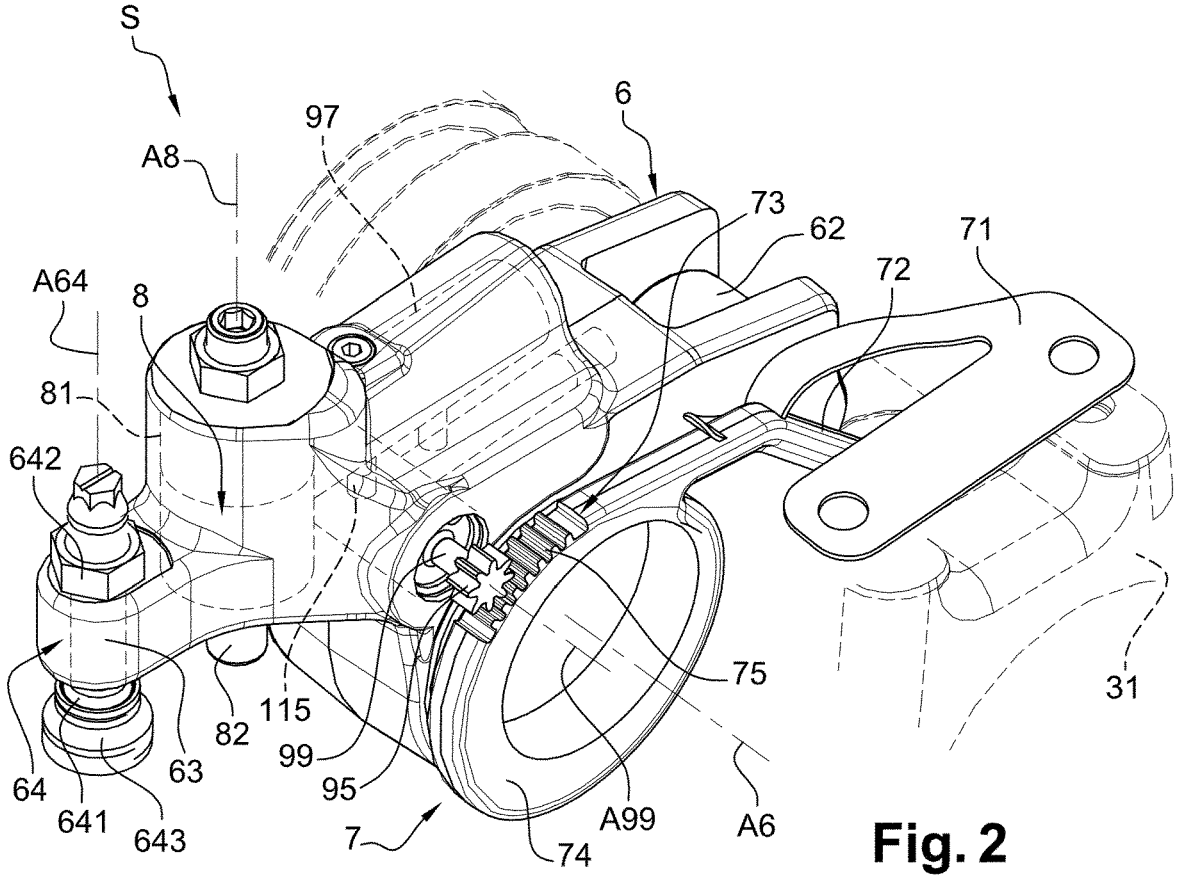
FIG. 2 is a perspective view of the valve actuation system of FIG. 1, showing a rocker, a lever and a piston pertaining to said system.
Figure 3:
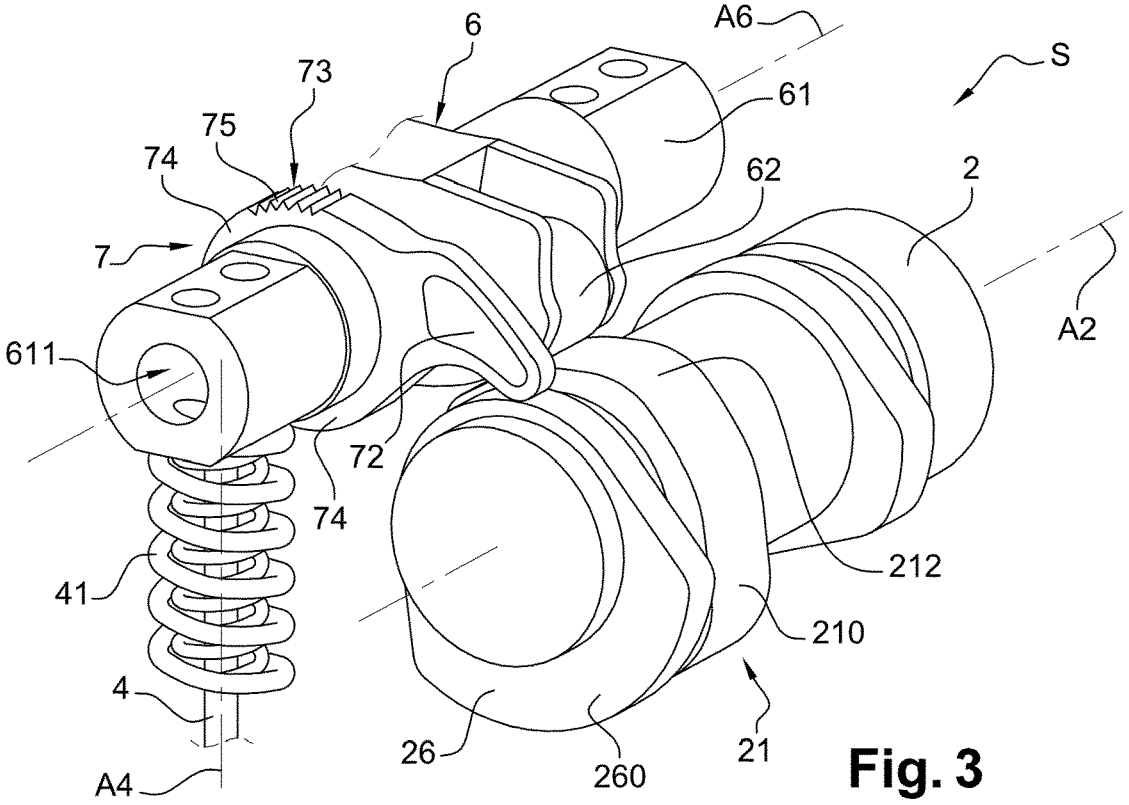
FIG. 3 is a partial perspective view of the engine arrangement of FIG. 1, further showing a camshaft.

As this is illustrated in FIGS. 1 to 3, the invention relates to an engine arrangement 1 of a non-represented automotive vehicle.

The engine arrangement 1 comprises a cylinder head 3 of an internal combustion engine of the vehicle, on which cylinder head 3 is secured a bracket 31 for mounting a valve actuation system S, i.e. a camshaft 2. The cylinder head 3 includes openings 32 for receiving the valves of the engine. In this embodiment, each cylinder of the engine is equipped with two inlet valves (not shown), and two exhaust valves 4, 5, namely an inner exhaust valve 4 and an outer exhaust valve 5. The valves have respective axes A4, A5.

Figure 10A:
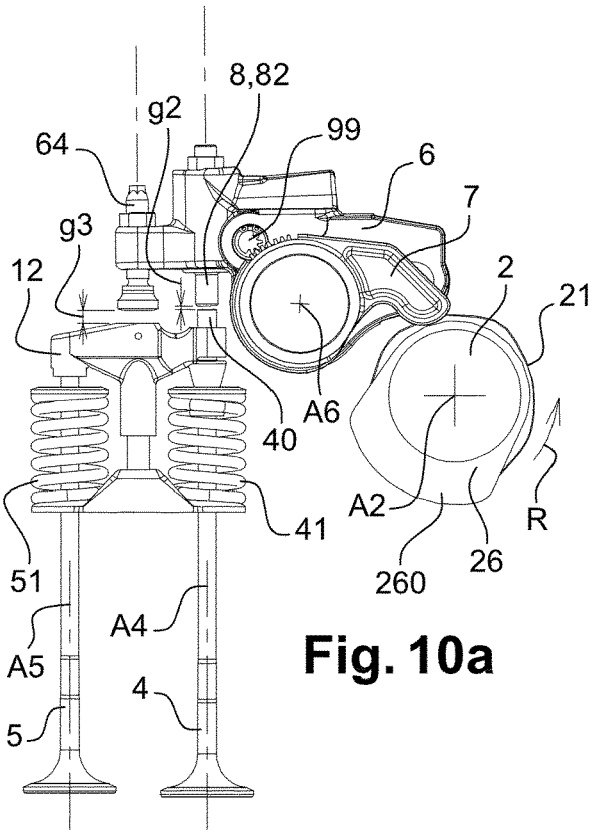
FIGS. 10*a* to 15*b* schematically show the engine arrangement during various phases of the engine cycle.

Valves 4 and 5 are kept in a closed position by respective springs 41 and 51 (not shown on FIG. 1, but visible on FIGS. 3 and 10*a*, for example). Each valve 4 and 5 is movable in translation along its respective axis A4, A5 so as to be opened, or lifted. More precisely, translation of valves 4 and 5 opens a passageway between the combustion chamber of the cylinder and an exhaust manifold. Valves 4 and 5 are partly represented on FIGS. 1 and 3, only their respective stems being visible.

The engine arrangement 1 also comprises the camshaft 2 having an axis A2, said camshaft 2 being rotatably mounted around its axis A2 in an opening 33 of the bracket 31. On the camshaft 2 are fastened cams for moving the cylinder valves, among which one cam 21 dedicated to move the exhaust valves 4, 5 of each cylinder. The cam 21 includes a main bump 210 and at least one auxiliary bump having a smaller radial dimension than the main bump 210. The bumps are valve lift sectors where the cam profile exhibits a bigger eccentricity with respect to axis A2 than the base radius of the cam 21. In the disclosed embodiment, the cam 21 comprises two auxiliary bumps 211, 212 (see FIG. 10*b*). Besides, a reset cam 26 including at least one bump 260 is also fastened on the camshaft 2. The reset cam 26 is offset with respect to cam 21 along axis A2.

With reference to FIG. 1, longitudinal axis X is defined as being parallel to axis A2 of the camshaft, vertical axis Z as being parallel to axes A4, A5 of the valves 4, 5 and transverse axis Y as being orthogonal to axes X and Z. It has to be noted that the term "vertical" is used for simplifying the description, but does not limit the possible orientation of the engine arrangement 1.

The valve actuation system S comprises a rocker 6 which is pivotably mounted around a pivot axis A6 and a lever 7 which is also pivotably mounted around a pivot axis. In the depicted embodiment, the rocker 6 and the lever 7 are pivotably mounted around one and the same pivot axis A6, although their pivoting movements are different. More specifically, a rocker shaft 61 is rotatably mounted around its axis A6 on the bracket 31. The rocker 6 is secured to the rocker arm shaft 61 whereas the lever 7 is able to rotate around the rocker arm shaft 61. A shown on FIGS. 2 and 3, the lever 7 is mounted adjacent a side face of the rocker 6 along axis A6.

The rocker 6 comprises a driven end portion 62 adapted to cooperate with the cam 21, i.e. to follow the peripheral face of said cam 21. The driven end portion 62 can comprise a roller.

The rocker 6 also comprises an actuating end portion 63 located opposite the driven end portion 62 relative to axis A6. As a result, when the driven end portion 62 contacts a bump of the cam 21, the rocker 6 is pivoted such that the driven end portion 62 is moved away from axis A2, substantially along axis Z, and the actuating end portion 63 is moved substantially along axis Z in the opposite direction. The actuating end portion 63 comprises a fixed activation member 64 and a sliding piston 8.

Figure 6:
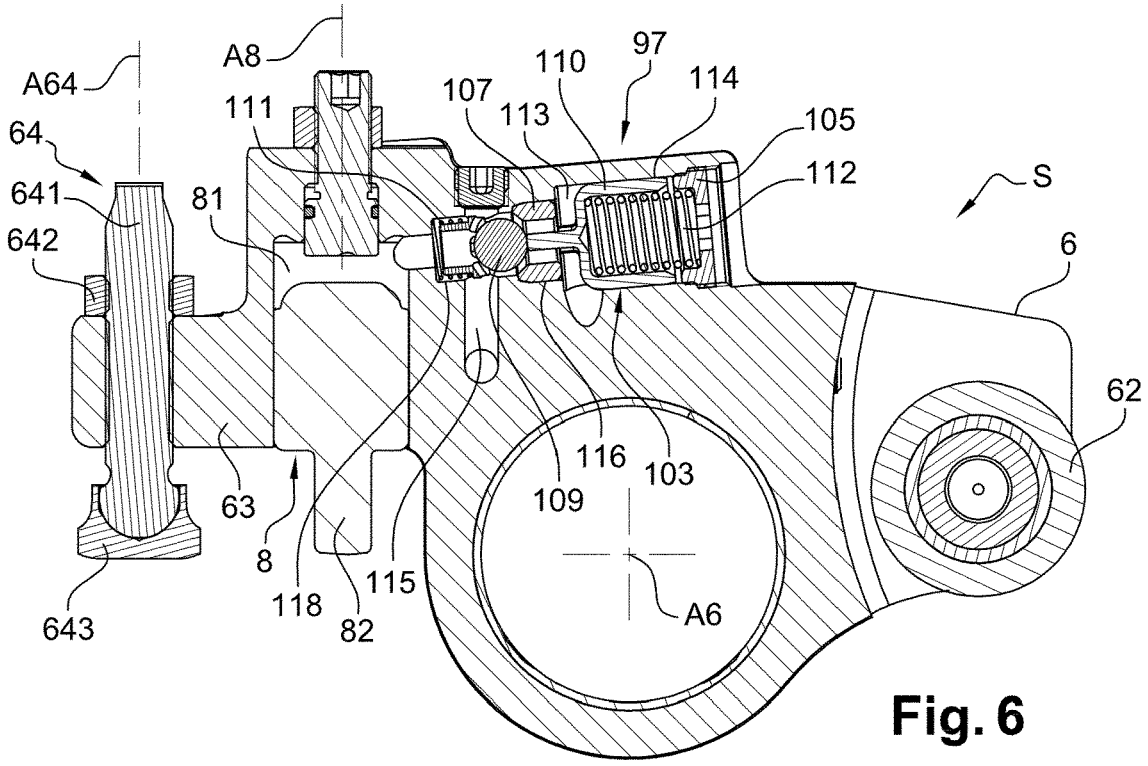
FIG. 6 is a sectional view of the valve actuation system showing a fluid circuit for moving the piston.
Figure 7:
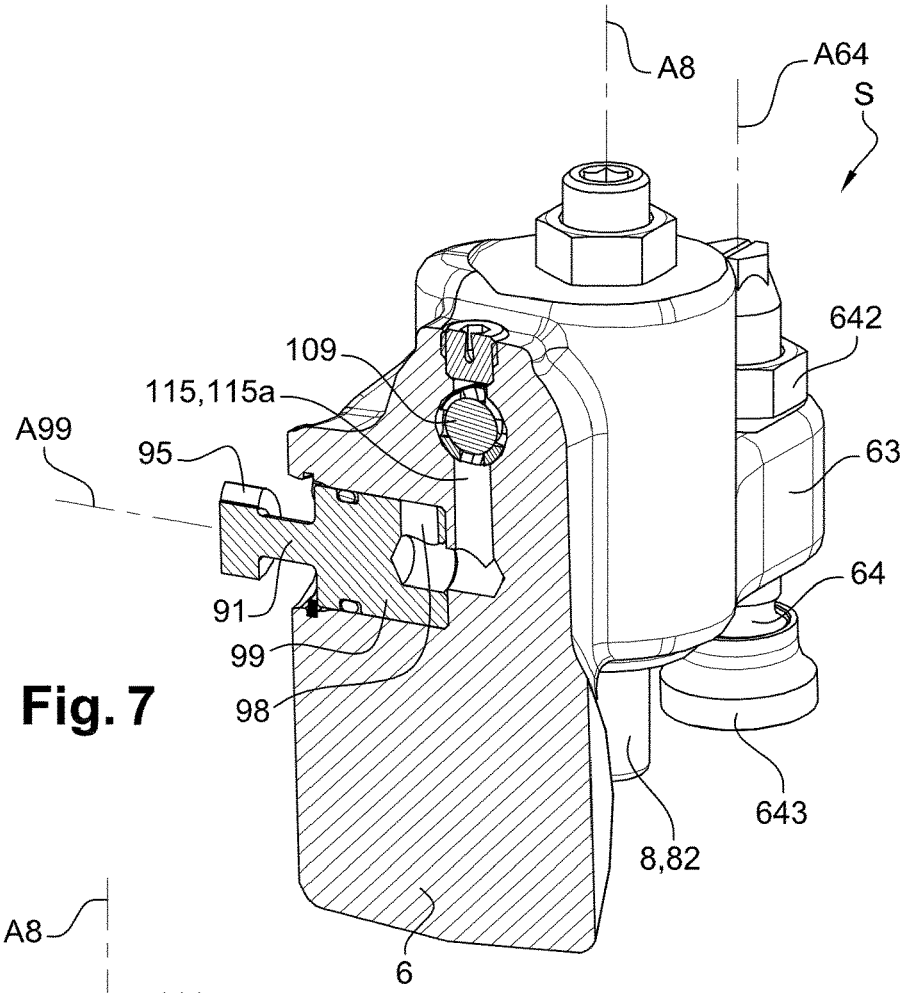
FIG. 7 is another sectional view of the valve actuation system showing said fluid circuit and a reset circuit.

The activation member 64, best shown in FIG. 6, has an axis A64 parallel to the valve axes A4, A5. The activation member 64 comprises a rod 641 the position of which, along Z, can be adjusted relative the rocker 6 by means of an adjusting screw 642. However, in operation, the activation member 64 is fixedly mounted on the rocker 6. The free end of rod 641 facing the cylinder block 3 is equipped with a pad 643 through a ball joint coupling. The activation member 64 is adapted to cooperate with a valve bridge 12 which cooperates with both valves 4, 5, so as to simultaneously open said valves 4, 5 following the cooperation of the driven end portion 62 of the rocker 6 with the cam main bump 210. The valve bridge 12 forms a valve opening actuator, and extends substantially perpendicularly to axes A4 and A5.

The piston 8 has an axis A8 parallel to the valve axes A4, A5. The piston 8 is housed in a chamber 81 of the rocker 6, and can slide inside said chamber 81 along axis A8. The piston 8 comprises a member 82 protruding towards the cylinder block 3. In the depicted embodiment, the piston axis A8 is aligned with the inner valve axis A4. An opening member 40 secured to the valve 4 is slidably engaged in a hole 13 arranged in the valve bridge 12. The opening member 40 is operable by the piston 8, so that the piston 8 is able to open only the inner valve 4, following the cooperation of the driven end portion 62 of the rocker 6 with a bump of the cam 21, as will be explained later. More specifically, as it will be explained below in more detail, the piston 8 is slidably mounted relative the rocker 6, inside chamber 81, between:

- a retracted position (FIG. 9), in which a gap g1 is provided between the piston 8 and the opening member 40 of valve 4, thus preventing the piston 8 to open the valve 4 when the driven end portion 62 of the rocker 6 contacts an auxiliary bump 211, 212 of the cam 21 (FIGS. 10*b*, 11*b*, 12*b*, 13*b*, 14*b*, 15*b*);
- and an extended position (FIGS. 8, 10*a*), in which gap g1 is reduced to g2, i.e. the end of piston 8 has come closer to the opening member 40 of valve 4, thus allowing said piston 8 to open valve 4 when the driven end portion 62 contacts an auxiliary bump 211, 212 of the cam 21. In an embodiment, the piston 8 allows activating an engine brake function when it is in its extended position.

The rocker 6 comprises a fluid circuit for providing a fluid, such as pressurized oil, to chamber 81, in order to cause the piston 8 to move from its retracted position to its extended position. The fluid circuit is internally arranged in rocker 6.

In the shown embodiment, rocker shaft 61 is hollow and defines a duct 611 (FIG. 3) which is connected to a non-shown fluid tank, and to the chamber 81 housing piston 8, via a check valve 97 (FIG. 6). When the engine switches to engine brake mode, check valve 97 is opened so that fluid can flow from duct 611 to the inside of rocker 6 and subsequently to the chamber 81 so as to induce a pressure raise and cause piston 8 to be moved towards its extended position.

The fluid circuit comprises a main duct 103 which is connected to the duct 611 inside rocker shaft 61 via an inlet duct 102 (FIG. 8), and which fluidly links check-valve 97 with the chamber 81. Main duct 103 opens on the outside of rocker 6 and fluid is prevented from going out of rocker 6 by a shutter element 105 screwed into a threaded portion of main duct 103. The main duct successively comprises an enlarged portion 114 (FIG. 6), an intermediate portion 116, and an outlet portion 118 opening in the camber 81.

A seat element 107 is press-fitted into main duct 103, in intermediate portion 116. A ball 109 of check-valve 97 is adapted to cooperate with seat element 107 so as to block passage of fluid from piston chamber 81 back to duct 611, and thus maintain piston 8 in its extended position when the piston 8 is pushing the opening member 40. Ball 109 is biased towards seat element 107 by a spring 111 arranged in the outlet portion 118, and therefore tends to close the check-valve 97. When no control pressure comes from duct 611, ball 109 is kept in open position by a plunger 110 spring-biased by a spring 112 arranged in the enlarged portion 114, the action of the spring 112 being superior to the action of spring 111. The inlet duct 102 is connected to the enlarged portion 114, in an area called chamber 113 which is located on the side of the plunger 110 opposite the spring 112. In other words, fluid coming from duct 611 first flows into chamber 113.

The rocker 6 also comprises a reset circuit for draining the fluid out of the chamber 81 of fluid circuit to allow the piston 8 to move towards its retracted position. The reset circuit comprises a by-pass duct 115 (FIGS. 6 to 9) which originates from main duct 103, more specifically from the outlet portion 118 of main duct 103, i.e. between the ball 109 and the chamber 81, and which opens on the outside of rocker 6, to the rocker shaft 61. In the by-pass duct 115 is arranged a reset valve 99 which is mounted relative to the rocker 6. Thus, an upstream portion 115*a* of the by-pass duct 115 is defined between the main duct 103 and the reset valve 99, and a downstream portion 115*b* of the by-pass duct 115 is defined between the reset valve 99 and the outside of rocker 6.

The reset valve 99 is distinct from the check valve 97, and is adapted to rotate around its axis A99 which is parallel to axis A6. The reset valve 99 comprises an inside passage 98 for allowing fluid communication between the upstream portion 115*a* and the downstream portion 115*b* of the by-pass duct 115. Thus, reset valve 99 is rotatably mounted relative to the rocker 6 between an inactive position (FIG. 8), in which the main duct 103 and the downstream portion 115*b* of the by-pass duct 115 are not in fluid communication, and an active position (FIG. 9) in which the reset valve 99 opens the by-pass duct 115 so that the fluid can be drained out of the fluid circuit. The inside passage 98 can be a hollow sector, as shown on FIG. 8 for example, or can comprise two orthogonal bores, as shown on FIGS. 10*b*, 11*b*, 12*b*, 13*b*. Other implementations can be envisaged.

The lever 7 has a driven end portion 72 adapted to cooperate with the reset cam 26, i.e. to follow the peripheral face of said cam 26. In an embodiment, the driven end portion 72 comprises a leg which protrudes substantially radially away from the pivot axis A6, the free end of said leg 72 being adapted to be in contact with the reset cam 26.

The lever 7 also comprises an actuating end portion 73 for rotating the reset valve 99 from its inactive position towards its active position following the cooperation of the lever driven end portion 72 with the bump 260 of the reset cam 26. In the depicted embodiment, the lever 7 comprises a ring-shaped portion 74 engaged around the rocker shaft 61, and from which protrudes the leg 72. The ring-shaped portion 74 has a cylindrical outer surface on which is provided the actuating end portion 73. More specifically, in an embodiment, said cylindrical outer surface is provided with teeth 75 extending parallel to axis A6.

An elastic member 71, such as represented in FIG. 2, or an elastic member 11, such as represented in FIG. 1, may be provided to ensure the driven end portion 72 is maintained in contact with the reset cam 26. In an embodiment, as shown in FIG. 2, the elastic member 71 can be configured as a leaf having one portion fastened to the leg 72 of lever 7 and one portion secured to the bracket 31. In an alternative, as shown in FIG. 1, the elastic member 11 can be configured as a latch pushing a pin 77 of the lever 7, wherein the pin 77 extends in parallel to the axis A6 and extends from the ring-shaped portion 74.

Moreover, the reset valve 99 comprises a rod 91 (FIG. 7) which protrudes outside the rocker 6 towards the lever 7, parallel to axis A6. Said rod 91 is provided with teeth 95 extending parallel to axis A6. The teeth 75 of the lever 7 and the teeth 95 of the reset valve 99 form rotational coupling means between the lever 7 and the reset valve 99.

Figure 4:
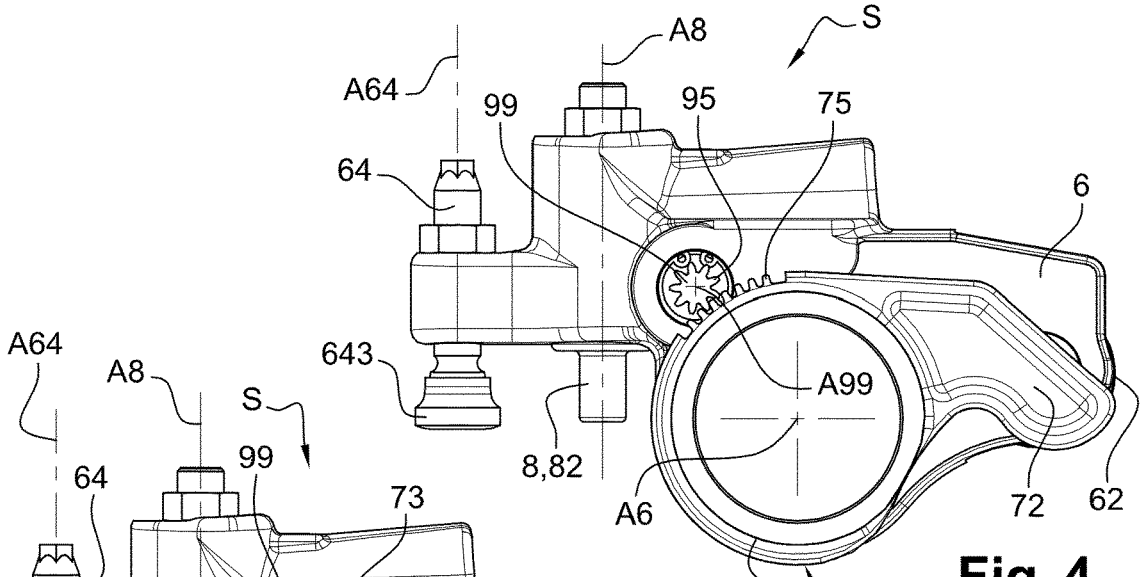
FIGS. 4 and 5 are side views of the valve actuation system of FIG. 2, the lever being in two different positions.
Figure 5:
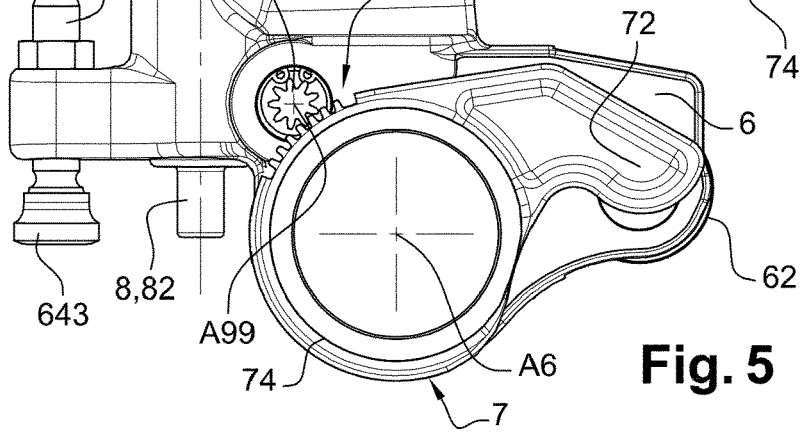
Figure 8:
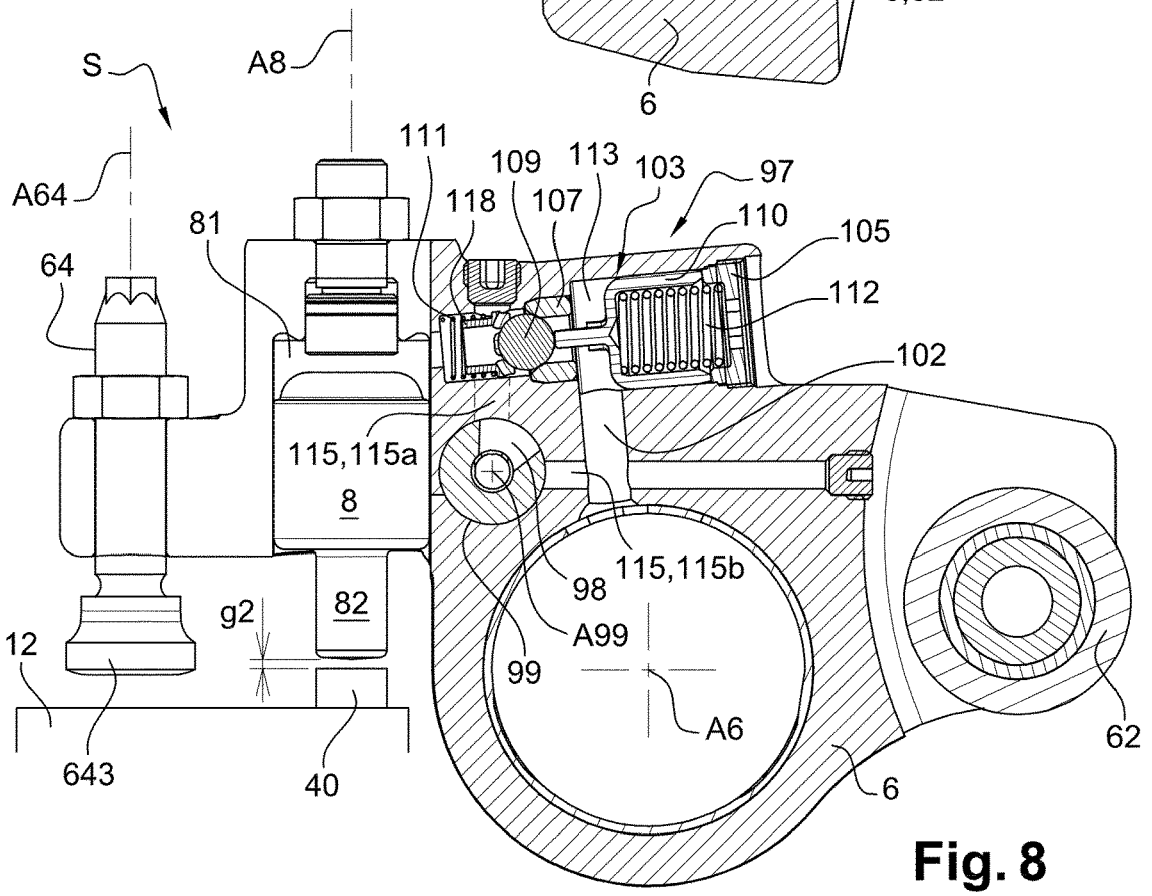
FIGS. 8 and 9 are sectional views of the valve actuation system showing two operating configurations of the fluid circuit and reset circuit.

Thus, when the leg 72 is in contact with the reset cam 26, not on the bump 260, the lever 7 is in the position shown on FIG. 4, and the reset valve 99 is in the inactive position shown on FIG. 8. When the leg 72 is in contact with the bump 260 of the reset cam 26, the lever 7 has pivoted around axis A6 to the position shown on FIG. 5.

Figure 9:
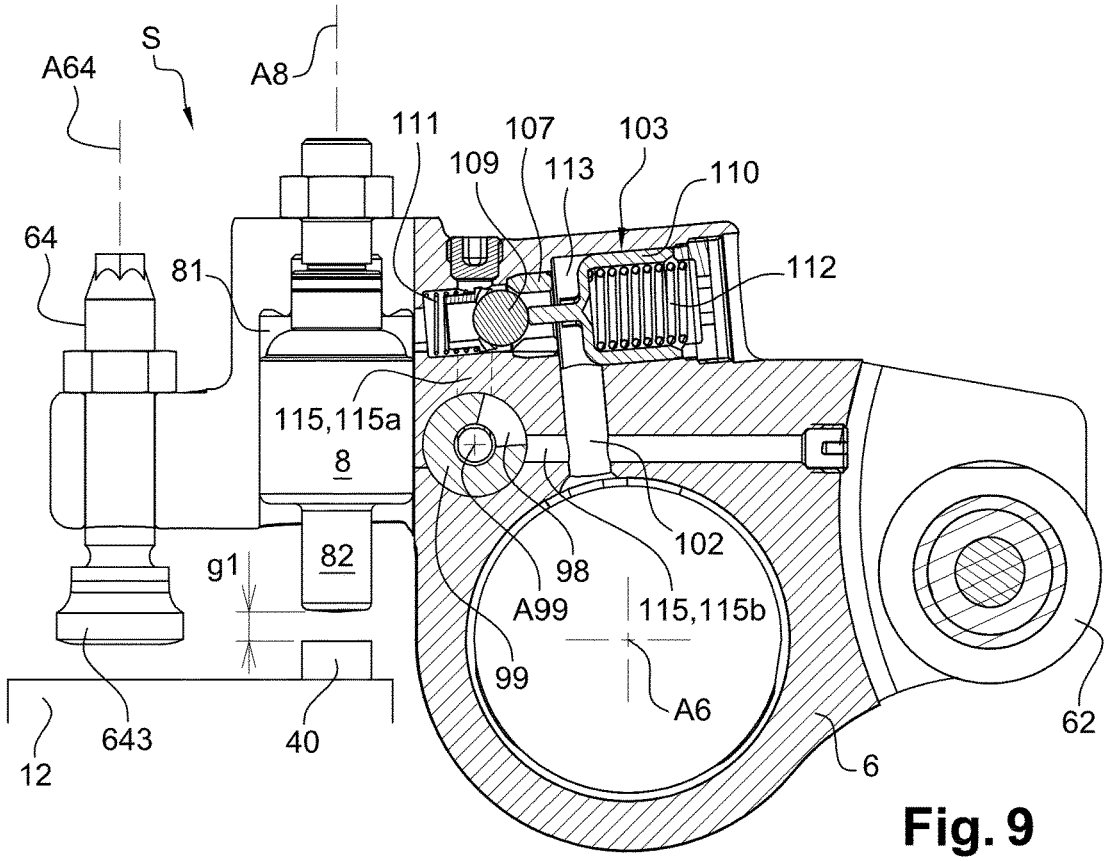

Consequently, via the rotational coupling means, the lever 7 has caused the reset valve 99 to rotate towards its active position shown on FIG. 9.

The rotational coupling means are configured to provide a transmission ratio greater than 1. To ensure an adequate operation of the valve actuation system S in a limited space, the transmission ratio can range from 2 to 15, preferably from 3.6 to 9, said transmission ratio being for example around 5.5.

For example, the valve actuation system S can be dimensioned as follows:

- radial distance between axis A6 and A99: around 35 mm;
- pitch radius of rod 91 with teeth 95: around 5.5 mm;
- pitch radius of ring-shaped portion 74 of lever 7, with teeth 75: around 30 mm;
- gear module: around 1.2.

In an embodiment, a 10° rotation of lever 7 can lead to a 54° rotation of the reset valve 99, which corresponds to a transmission ratio of 5.4. The maximum rotation of the lever 7 can be around 15°.

With the above described arrangement, on each turn of camshaft 2:

- cooperation between the main bump 210 of cam 21 and driven end portion 62 of roller 6, on the one hand, and between activation member 64 and valve bridge 12, on the other hand, generate opening of valves 4 and 5 during the corresponding operating phase of the internal combustion engine (exhaust phase);
- when the engine brake mode is activated, i.e. when the exhaust pipe has been closed by a flap manifold (not represented) located in the exhaust pipe downstream from the turbine of the turbocharger and when the piston 8 has been moved by pressurized fluid towards its extended position, cooperation between the auxiliary bumps 211, 212 of cam 21 and driven end portion 62 of roller 6, on the one hand, and between piston 8 and opening member 40 of valve 4, on the other hand, generate additional and limited openings of valve 4 only, so as to perform an engine brake function at two precise moments during operation of engine;

cooperation between the bump 260 of reset cam 26 and driven end portion 72 of the lever 7, on the one hand, and between teeth 75 of the lever 7 and teeth 95 of the reset valve 99, on the other hand, causes opening of the check valve and consequently draining of the fluid circuit, i.e. movement of the piston 8 back to its retracted position.

The dedicated reset cam 26 is adapted to create a relative movement of the lever 7, and thus of the reset valve 99, with respect to the corresponding rocker 6. This relative movement is nevertheless coordinated with the movement of the rocker 6 with respect to the engine housing, so that the reset function is performed at a selected given time within the opening/closing cycle of the valves 4 and 5.

When the engine brake function is not activated (FIG. 9), check valve 97 is in opened position, due to action of the spring biased plunger 110, and piston 8 is retracted in chamber 81. A gap g1 is provided between member 82 of piston 2 and the opening member 40 of valve 4. The driven end portion 62 is in contact with the peripheral face of said cam 21. When the driven end portion 62 comes in contact with one of the auxiliary bump 211, 212 of cam 21, the rocker 6 pivoting movement is not sufficient, because of gap g1, to make member 82 come in contact with opening member 40. The valve opening movement thus only results from the cooperation of activation member 64 and valve bridge 12, following the contact between the rocker 6 and the main bump 210 of cam 21.

The way the invention operates when the engine brake mode is activated, on each turn of camshaft 2, will be described with reference to FIGS. 10*a*-15*b* which show the valve actuation system Sat various moments of the engine cycle. FIGS. 10*a*, 11*a*, 12*a*, 13*a*, 14*a*, 15*a* show the position of the lever 7 cooperating with reset cam 26, while FIGS. 10*b*, 11*b*, 12*b*, 13*b*, 14*b*, 15*b* show the position of the rocker 6 cooperating with cam 21 at the respective corresponding moments.

Figure 10B:
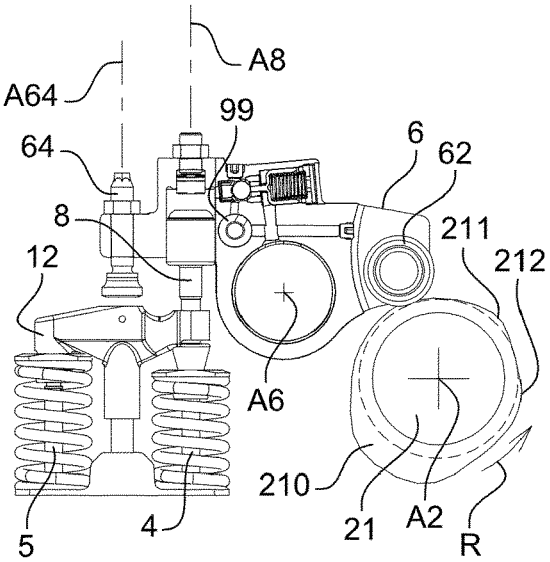

On FIGS. 10*a* and 10*b*, the roller 62 of rocker 6 is in contact with the base radius portion of cam 21, and the leg 72 of lever 7 is in contact with the base radius portion of reset cam 26. As piston 8 has moved towards its extended position, because the engine brake mode has been activated, gap g1 is reduced to g2, which is lower than the gap g3 provided between the activation member 64 and the valve bridge 12. Piston 8 is thus ready to cooperate with opening member 40 to open valve 4 when roller 62 comes into contact with one auxiliary bump 211, 212. Reset valve 99 is inactive.

Camshaft 2, cam 21 and reset cam 26 rotate together around axis A2 according to arrow R shown on FIGS. 10*a*-15*b*.

Figure 11A:
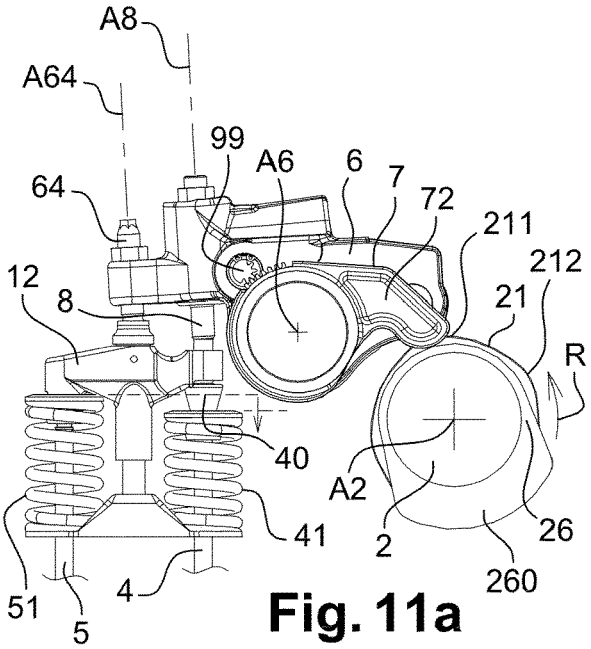
Figure 11B:
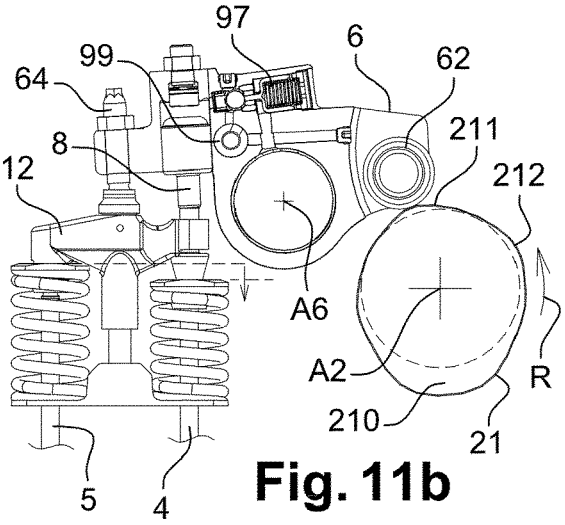
Figure 12A:
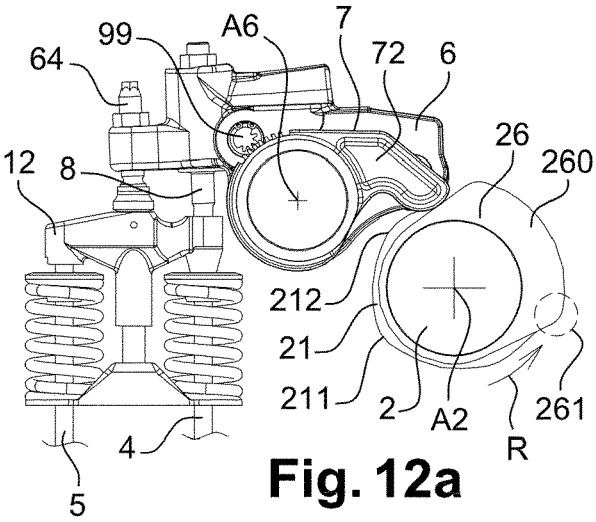
Figure 12B:
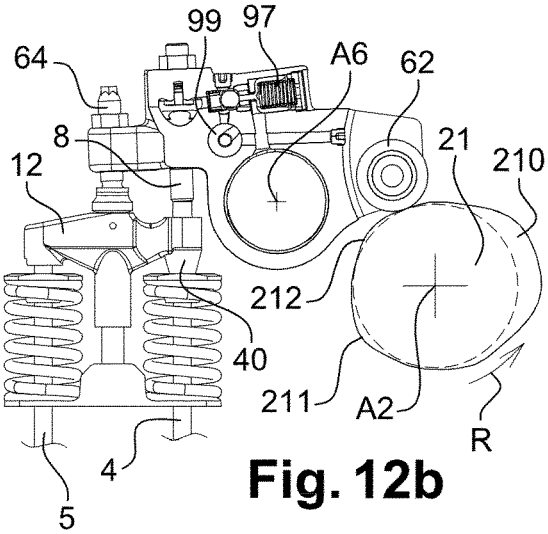

In the phase illustrated on FIGS. 11*a* and 11*b*, the roller 62 is in contact with one auxiliary bump 211 of cam 21. As a result, rocker 6 pivots and piston 8 pushes opening member 40, causing valve 4 to be slightly opened, to perform an engine brake function. Check valve 97 is closed. Gap g3 has been reduced but a clearance still exists, meaning that activation member 64 and valve bridge 12 do not cooperate. The lever 7 has not pivoted as leg 72 is still in contact with the base radius portion of reset cam 26. Therefore, reset valve 99 is still in its inactive position.

When the roller 62 has passed auxiliary bump 211 it is in contact with the base radius portion of cam 21. Check valve 97 re-opens.

As rotation of camshaft 2 continues, the roller 62 can come in contact with a further auxiliary bump 212 of cam 21 (this phase not being illustrated).

Figure 13A:
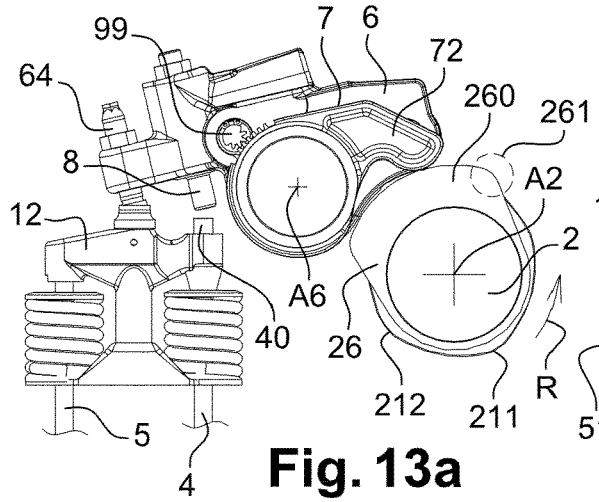
Figure 13B:
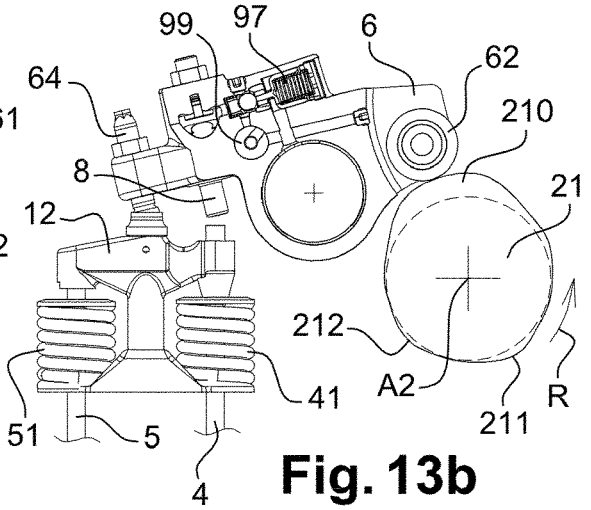

In the position shown in FIGS. 13*a* and 13*b*, as roller 62 of rocker 6 comes in contact with the main bump 210 of cam 21, it is pivoted according to a greater range, causing activation member 64 to push the valve bridge 12, and to fully open both valves 4, 5, to perform the exhaust phase of the engine cycle. Springs 41 and 51 are compressed. Check valve 97 is closed.

Figure 14B:
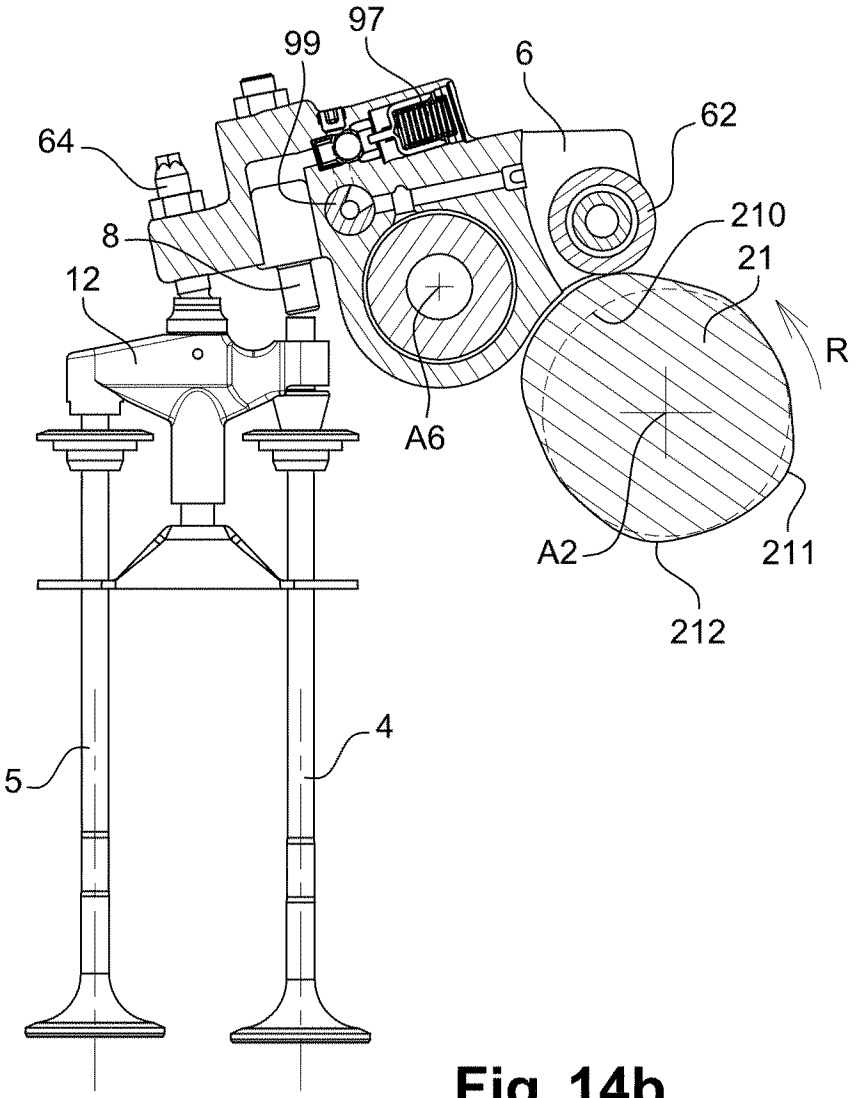
Figure 14A:
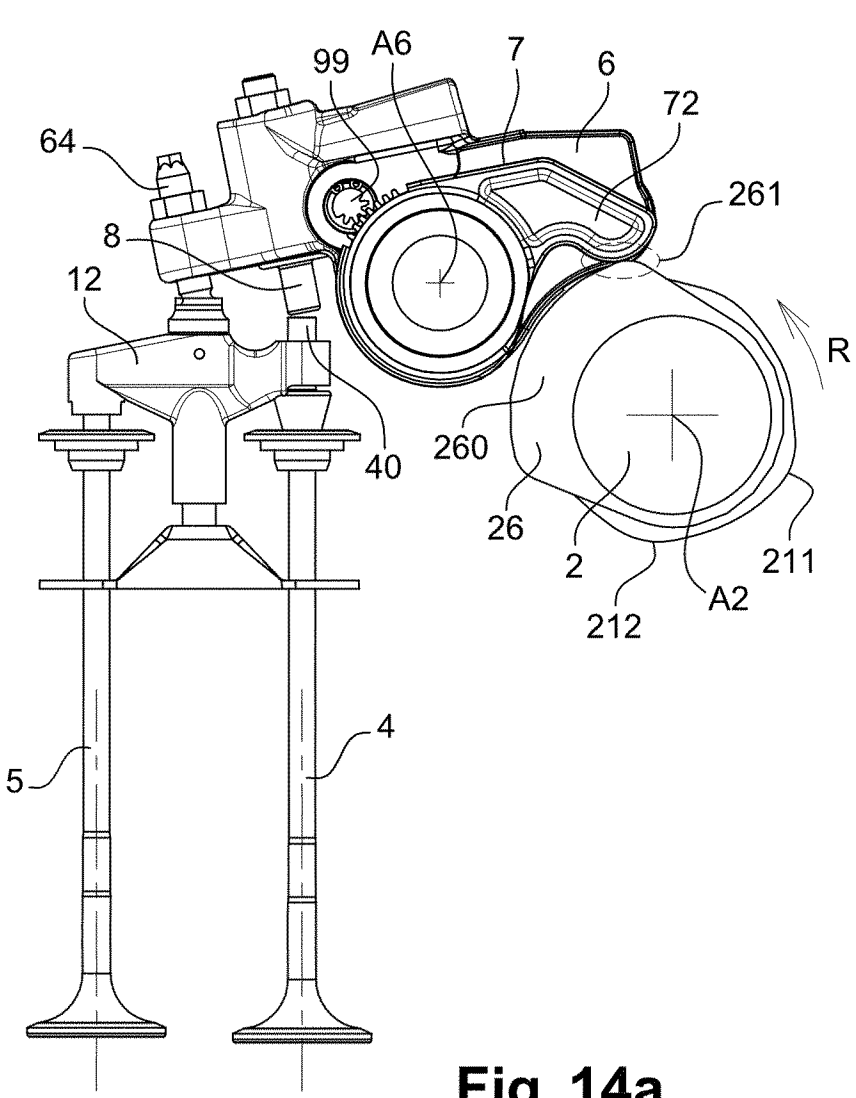

As shown on FIGS. 14*a* and 14*b*, while the roller 62 is progressively coming back in contact with the base radius portion of cam 21, leg 72 of lever 7 remains in contact with the bump 260 of reset cam 26. Indeed, the bump 260 has angular range that angularly extends beyond the main bump 210 of cam 21 and up to a corner 261 of the bump 260. It results from this difference that the rocker 6 rotates with respect to the lever 7, in other words an angular offset is created between the rocker 6 and the lever 7, causing the reset valve 99 to begin to rotate, in function of the predetermined transmission ratio between the lever 7 and the reset valve 99, around axis A99, towards its active position.

The reset valve 99 begins to open whereas the check valve 97 is still closed and the reset valve 99 reaches its active position, preferably before the roller 62 of rocker 6 comes in contact with the base radius portion of cam 21. As soon as the reset valve 99 begins to open, the fluid circuit starts being drained through the by-pass duct 115 and piston 8 moves back to its retracted position.

Figure 15A:
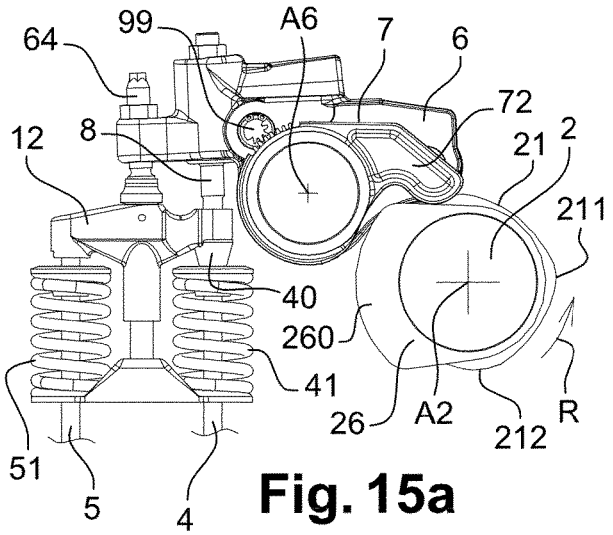
Figure 15B:
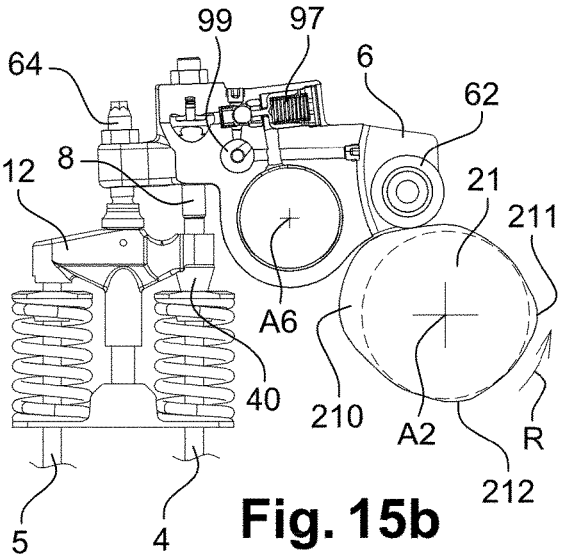

Finally, as shown on FIGS. 15*a* and 15*b*, the reset valve 99 and the by-pass duct 115 are still opened, but the leg 72 is progressively coming back in contact with the base radius portion of reset cam 26 reducing the angular offset between the rocker 6 and the lever 7. The reset valve 99 is thus rotated towards its inactive position and the piston 8 is moved towards its extended position by fluid pressure inside the fluid circuit. The valve actuation system is then ready for another cycle.

Figure 16:
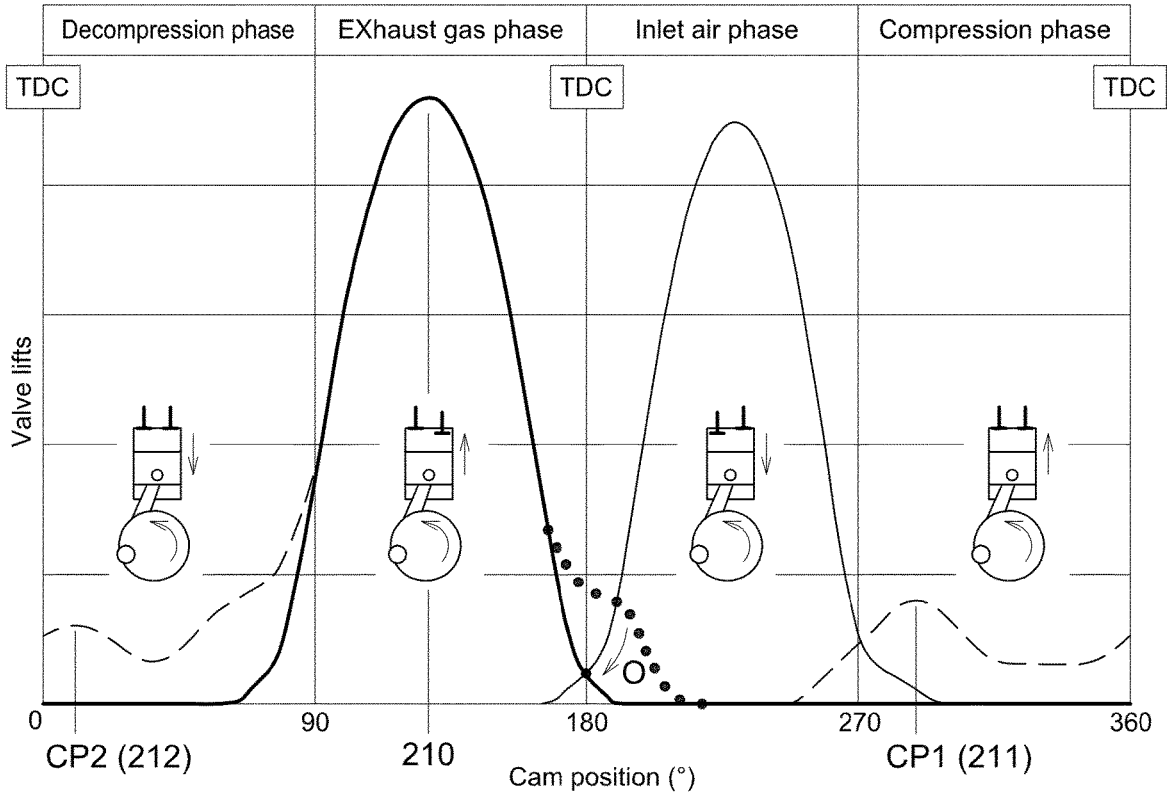
FIG. 16 is a diagram showing the evolution of the lifts of the inlet and exhaust valves of the engine arrangement during one engine cycle.

FIG. 16 shows the valve lifts as a function of the camshaft rotation, namely:

the inlet valve lift;

the outer exhaust lift (valve 5);

the inner exhaust lift (valve 4).

CP1 is the cam position corresponding to auxiliary bump 211: owing to the slight opening of valve 4, more air is added in the cylinder chamber at the beginning of the compression phase. CP2 is the cam position corresponding to auxiliary bump 212: owing to the slight opening of valve 4, air is decompressed out of the cylinder chamber in the decompression phase, just before the top dead centre (TDC).

Owing to the lever 7 and its specific movement as previously described, the reset valve 99 allows closing the inner exhaust valve 4 at the same time as the outer exhaust valve 5, i.e. causes an asymmetric movement profile of valve 4. As a result, overlap O is reduced as schematically illustrated by arrow O on FIG. 15. Reducing overlap, i.e. the time period when both the intake and exhaust valves are open, allows improving the engine brake effect.

It is to be understood that the present invention is not limited to the embodiments described above and illustrated in the drawings; rather, the skilled person will recognize that many changes and modifications may be made within the scope of the appended claims.

The invention claimed is:

1. A valve actuation system for an internal combustion engine, said valve actuation system comprising:

a rocker pivotally mounted around a pivot axis, the rocker including:

a rocker driven end adapted to engage a rotating cam including a main bump and at least one auxiliary bump having a smaller radial dimension than the main bump;

a rocker actuating end equipped with at least one piston adapted to open at least one gas exchange valve of the engine when the cam actuates the rocker driven end, the at least one piston being slidably mounted to the rocker so as to switch between an extended position allowing said at least one piston to open said at least one gas exchange valve when the rocker driven end is actuated by the at least one auxiliary bump, and a retracted position preventing said at least one piston from opening said at least one gas exchange valve when the rocker driven end is actuated by the at least one auxiliary bump;

a fluid circuit including a fluid configured to move the at least one piston from the retracted position to the extended position; and a reset circuit including a reset valve rotatably mounted to the rocker, the reset valve configured to switch between an inactive position and an active position in which the fluid drains out of the fluid circuit so as to allow the at least one piston to move towards the retracted position; and a lever pivotally mounted around the pivot axis, the lever including:

a lever driven end adapted to engage a rotating reset cam including at least one bump; and a lever actuating end configured to rotate the reset valve via a rotational coupling means for rotating the reset valve from the inactive position towards the active position when the reset cam actuates the lever driven end, wherein said rotational coupling means has a transmission ratio greater than 1.

2. The valve actuation system according to claim 1, wherein the transmission ratio ranges from 2 to 15.

3. The valve actuation system according to claim 1, wherein the reset valve rotates about a reset valve axis which is parallel to the pivot axis.

4. The valve actuation system according to claim 1, wherein the rotational coupling means comprises:

a first set of teeth arranged on a cylindrical outer surface of the lever actuating end; and a second set of teeth arranged on a rod of the reset valve, the rod protruding from the rocker towards the lever.

5. The valve actuation system according to claim 1, wherein the lever driven end comprises a leg which protrudes substantially radially away from the pivot axis, said leg having a free end adapted to engage the reset cam.

6. The valve actuation system according to claim 1, further comprising an activation member fixed to the rocker actuating end, wherein said at least one gas exchange valve includes two gas exchange valves, and wherein said activation member is adapted to engage a valve bridge configured to simultaneously open the two gas exchange valves when the main bump actuates the rocker driven end.

7. The valve actuation system according to claim 1, wherein the at least one gas exchange valve is an exhaust valve.

8. The valve actuation system according to claim 7, wherein the at least one auxiliary bump is configured to activate an engine brake function when the at least one piston is in the extended position.

9. An engine arrangement comprising:

the valve actuation system according to claim 1;

a rocker shaft extending along the pivot axis such that the rocker and the lever are pivotally mounted on said rocker shaft; and a camshaft including the rotating cam and the reset cam, wherein the at least one gas exchange valve includes two gas exchange valves, and wherein the at least one piston is adapted to open at least a first gas exchange valve of said two gas exchange valves.

10. The engine arrangement according to claim 9, further comprising:

an activation member fixed to the rocker actuating end;

a valve bridge configured to simultaneously open the two gas exchange valves when the activation member actuates the valve bridge; and an opening member secured to an end of the first gas exchange valve, the opening member slidably engaged through a hole of the valve bridge such that only the first gas exchange valve is opened when the at least one piston actuates the opening member.

11. A vehicle comprising the valve actuation system according to claim 1.

* * * * *